US005957300A

United States Patent [19]

Nardi et al.

[11] Patent Number: 5,957,300

[45] Date of Patent: Sep. 28, 1999

[54] CLASSIFIER VANE FOR COAL MILLS

[75] Inventors: John Anthony Nardi, Clinton Township, Mich.; Rickey E. Wark, The Woodlands, Tex.

[73] Assignee: Sure Alloy Steel Corporation, Madison Heights, Mich.

[21] Appl. No.: 08/931,374

[22] Filed: Sep. 16, 1997

Related U.S. Application Data

[63] Continuation-in-part of application No. 08/591,933, Jan. 29, 1996, Pat. No. 5,819,947.

[51] Int. Cl.[6] ..... B07B 7/083

[52] U.S. Cl. ..... 209/143; 209/139.2; 209/714; 241/79.1; 241/119

[58] Field of Search ..... 209/143, 713, 209/714, 718, 715, 139.2; 241/79.1, 119

[56] References Cited

U.S. PATENT DOCUMENTS

| | | | |
|---|---|---|---|
| 3,040,888 | 6/1962 | Hosokawa et al. | 209/714 |
| 4,483,487 | 11/1984 | Katsuta et al. | 241/119 |
| 4,504,018 | 3/1985 | Diggins | 209/722 |
| 4,638,953 | 1/1987 | Taylor | 241/39 |
| 4,750,677 | 6/1988 | Taylor | 241/5 |
| 5,251,831 | 10/1993 | Yoshida et al. | 241/79.001 |
| 5,381,968 | 1/1995 | Lohnherr et al. | 241/19 |
| 5,533,629 | 7/1996 | Ito et al. | 209/714 |

*Primary Examiner*—Dean Kramer
*Assistant Examiner*—Thuy V. Tran
*Attorney, Agent, or Firm*—Young & Basile, P.C.

[57] ABSTRACT

An improved vane of the type adapted for use in the classifier cage of a bowl mill type coal pulverizer. The improved vane is designed such that its lower end extends below the classifier cage inlet when the vane is mounted in the inlet. In a preferred form, the vane has a generally trapezoidal shape with a longer lower edge. The vane is additionally bent or curved over a major portion to direct coal tangentially toward the surface of the classifier cone.

34 Claims, 11 Drawing Sheets

40
44
36
34
32
30
42
38
28
14
20
20
24
12
10
26
16
18

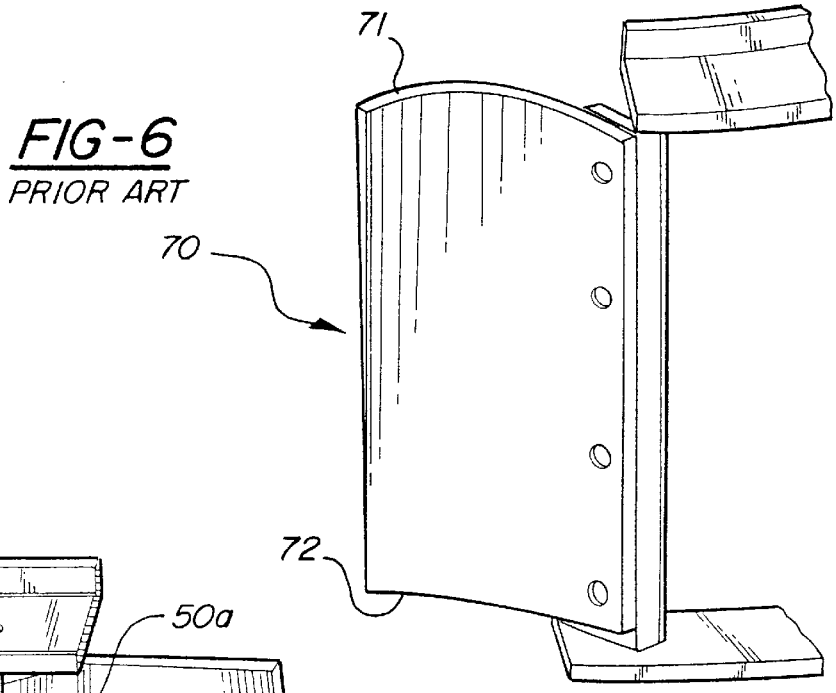
FIG-6
PRIOR ART
FIG-7
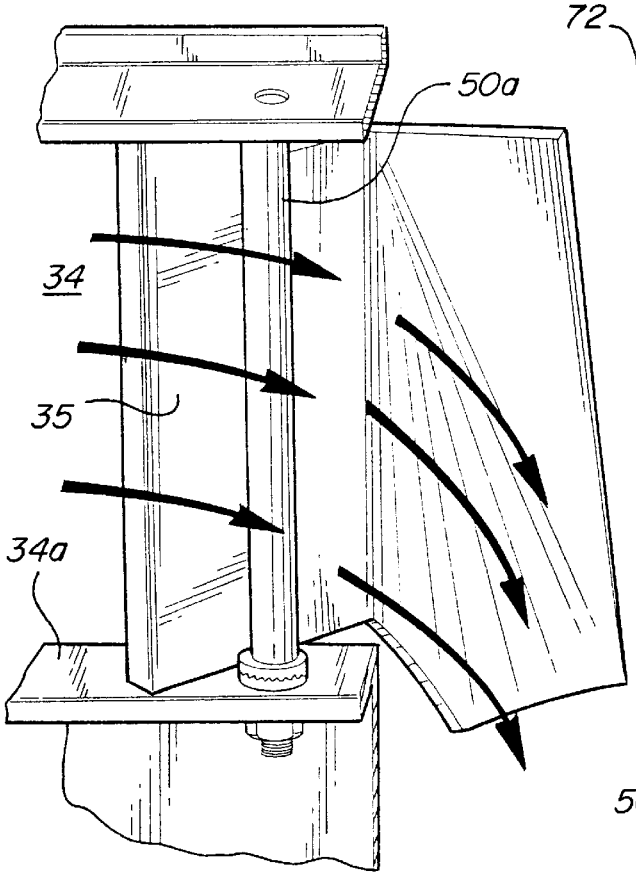
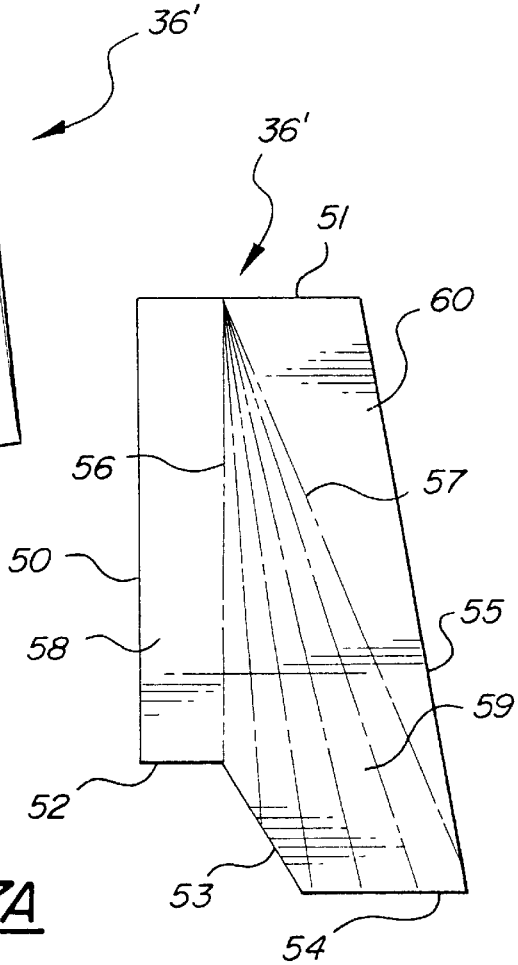
FIG-7A

CLASSIFIER VANE FOR COAL MILLS

CONTINUING APPLICATION DATA

This is a continuation-in-part of U.S. patent application Ser. No. 08/591,933 filed Jan. 29, 1996, now U.S. Pat. No. 5,819,947.

FIELD OF THE INVENTION

The present invention relates to bowl mill type coal pulverizers, and more particularly to the vanes in classifier cages found at the upper ends of such pulverizers for redirecting a flow of pulverized coal fines into a classifier cone.

BACKGROUND OF THE INVENTION

Coal pulverizers are extensively used in the power-generating industry to process coal into finely ground "fines" suitable for combustion. A common type of pulverizer is the bowl mill pulverizer, in which a bowl- or ring-shaped grinding plate is rotated while heavy grinding wheels crush and grind coal fed onto the plate from a feedpipe. Typically, a circular "throat" surrounds the outer edge of the grinding plate, and a stream of forced air is blown upward around the grinding plate to entrain the ground coal into a flow which spirals up and around the pulverizer into a classifier cone. Once in the classifier cone, the coal/air flow should be directed to swirl down into the classifier cone with a centrifugal classifying action, with the smaller coal fines separated up and out for combustion, and with larger coal particles not suitable for combustion swirled around the sides of the cone to eventually drop back into the pulverizer for regrinding.

The classifier cones are typically provided at their upper end with a circular classifier cage defining a circumferential inlet for the cone, the cage being filled with a number of classifier vanes which are used to direct the coal/air flow into the cone in a desired swirl pattern. Control over this swirl pattern is critical in maximizing control of the cone's classifying action, and the resulting fineness of the coal being burned.

The initial rotational direction of the coal/air flow around the pulverizer is imparted by a number of angled throat vanes in the throat, and subsequently modified by the classifier vanes to flow down and around inside the classifier cone. In the past, pulverizer throats have typically been stationary. Recently, however, the industry has been converting from stationary to rotating throats to improve flow efficiency from the throat. U.S. Pat. No. 4,721,258 to Dougan et al. describes a number of reasons for conversion from stationary to rotating throats. The Dougan et al. patent discloses an arrangement of pulverizer throat vanes (FIG. 4) in which the rotating throat vanes are oriented in the direction of rotation of the bowl and throat. This orientation is intended to take advantage of a specially-shaped throat vane having an airfoil portion.

However, it has since been found that orienting the throat vanes opposite the direction of the bowl/throat rotation is far more efficient, and has generally become the industry standard for rotating throat pulverizers. This results in a corresponding reversed rotation of the flow that reaches the classifier cage from the pulverizer throat.

Adjustment of the flow through the classifier cage is achieved with one of two types of adjustable vanes: fixed pitch vanes with lengthwise adjustable slide plates, and pivot-type vanes. The slide- and pivot-adjustments are intended to improve control over the flow into the classifier cone.

Prior art classifier vanes with lengthwise adjustments have been found not to help fineness control since they do not adjust tangential flow direction with respect to the interior surface of the cone. The pivot-type vanes offer better control over flow direction, using individual pivot adjustments or linkages to articulate sets of multiple vanes at the same time. However, pivoting alone is not sufficient to optimize directional control over the flow. Accordingly, some prior art vanes are additionally curved to help redirect flow.

SUMMARY OF THE INVENTION

The invention in its broadest form comprises an improved classifier vane in which the vane has a lower end extended down into the classifier cone below the inlet to direct flow tangentially relative to the interior surface of the cone.

In a preferred form the vane is generally trapezoidal with a wider lower end. By "trapezoidal" we mean shapes in which the interior or free edge of the vane is extended in angular fashion down and into the classifier such that it widens toward its lower end. This includes both true rectangular trapezoids, as well as other similar shapes.

In a further form the vane is additionally bent or curved over a major portion to further direct coal tangentially and downwardly relative to the interior surface of the classifier cone.

In a first embodiment, the vane has two primary angled portions: a funnel-like center region which widens from top to bottom; and, an outer deflector region which is set at a second, greater angle and which narrows from top to bottom to provide an initial downward redirection of flow without interfering with the tangential throw of coal from the lower edge of the vane.

In a second embodiment, the vane has one primary bend, with a major deflector surface essentially parallel to the angled surface of the cone. In an alternate version, this second embodiment can be modified with a second bend to increase the angle of the major deflector surface.

The result is a vane which better controls and guides the flow of coal as it initially enters the classifier to a release point which is essentially tangential to the interior wall of the classifier cone.

While the preferred use of the improved classifier vanes is with an improved classifier vane orientation for reversed-flow rotating throats, the subject of the parent application referred to above, they are likewise useful for improving the classifier operation in cooperation with stationary throats and rotating throats with non-reversed flow.

These and other features and advantages of the invention will become apparent upon further reading of the specification.

BRIEF DESCRIPTION OF THE DRAWINGS

FIG. 6 is a perspective front view of a prior art curved classifier vane;

FIG. 7 is a perspective view of the first embodiment of the improved classifier vane according to the present invention, in use with a classifier cage;

FIG. 7A is a front view of the vane of FIG. 7 laid flat;

DETAILED DESCRIPTION OF THE DRAWINGS

Figure 1:
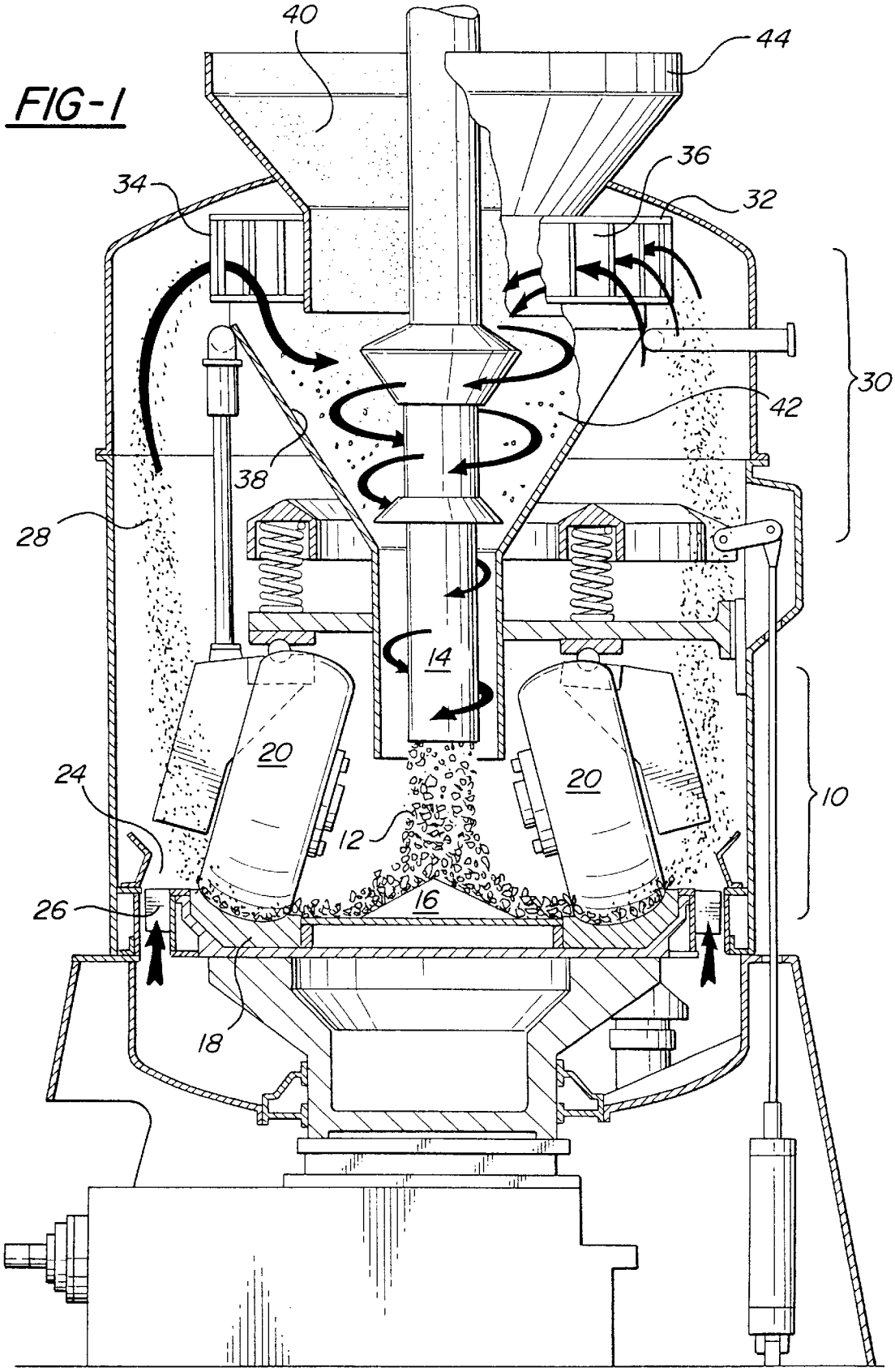
FIG. 1 is a side section view of a bowl mill type pulverizer with an associated classifier cone system, showing the flow of coal particles from the pulverizer through the classifying system.

Referring to FIG. 1, a pulverizer 10 and a classifier system 30 of known type are shown in section. In pulverizer 10 unground coal 12 is delivered from a feedpipe 14 to the middle of the pulverizer, where it is deflected by a diverter cap 16 radially outward onto a rotating grinding ring 18 to be crushed by grinding wheels 20. The direction of coal feed, bowl rotation and crushing action force the crushed coal "fines" over the edge of the grinding ring into a throat 24. Throat 24 is a circular, ring-shaped structure through which a steady stream of forced air flows upwardly from a known source (not shown), directed by a number of angled vanes 26 mounted in the throat around the circumference of the pulverizer. The resulting upwardly-directed air flow through throat 24 entrains and lifts the coal fines into a spiral flow 28 up and around the pulverizer to classifier structure 30.

For ease of explanation, the orientation of throat and classifier vanes and the resulting rotational flow direction are not intended to be specified in the side section view of FIG. 1, but are discussed below in views better suited to that purpose.

The rotating coal/air flow 28 from pulverizer 10 encounters a classifier cage 32, which defines a circumferential inlet 34 with a plurality of circumferentially-spaced classifier vanes 36. Vanes 36 direct the coal/air flow 28 from the pulverizer into a classifier cone 38. Inside the classifier cone 38 the centrifugal nature of the flow imparted to the coal from the classifier cage swirls the coal particles around the cone such that the smaller, lighter fines 40 are swirled up and out through a combustion outlet 44 to be burned. The larger particles 42, not yet suitable for burning, are separated centrifugally outward and eventually drop through the bottom of the cone where they rejoin the flow from feedpipe 14 for regrinding.

It is known by those skilled in the art that the greater the centrifugal nature of the flow imparted to the coal fines as they enter the classifier cone, the better the cone classifies the differently sized fines, resulting in better uniformity of the coal fines delivered for combustion. The centrifugal flow tends to spiral the lighter, properly-sized fines up and out the combustion outlet 44, while forcing the heavier particles outward against the sides of the classifier cone, where they lose velocity and eventually drop out through the cone outlet for regrinding.

Figure 1A:
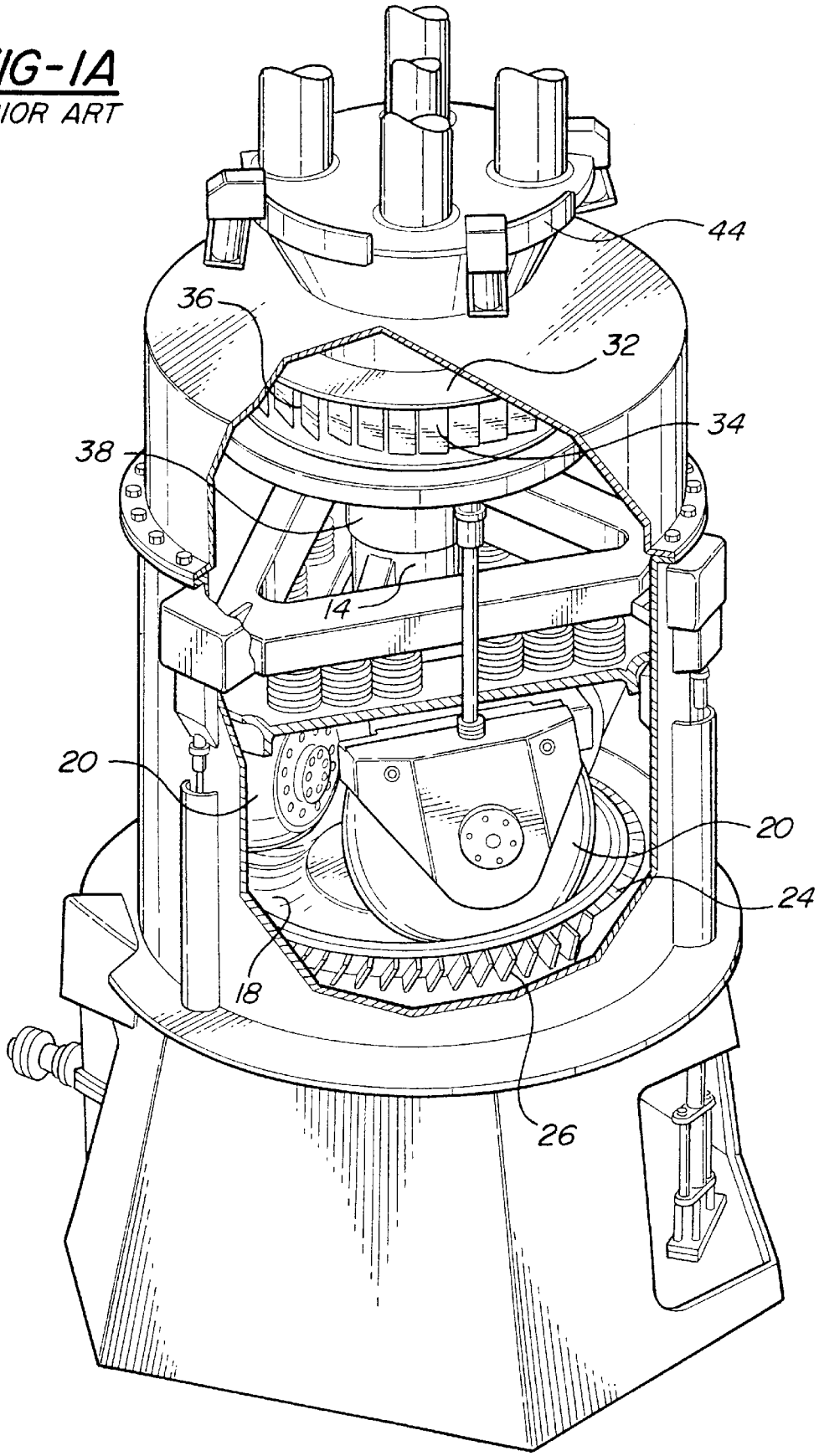
FIG-1A PRIOR ART
FIG. 1A is a perspective view, partially cut away, of a bowl mill type pulverizer incorporating a prior art classifier cage.
Figure 1B:
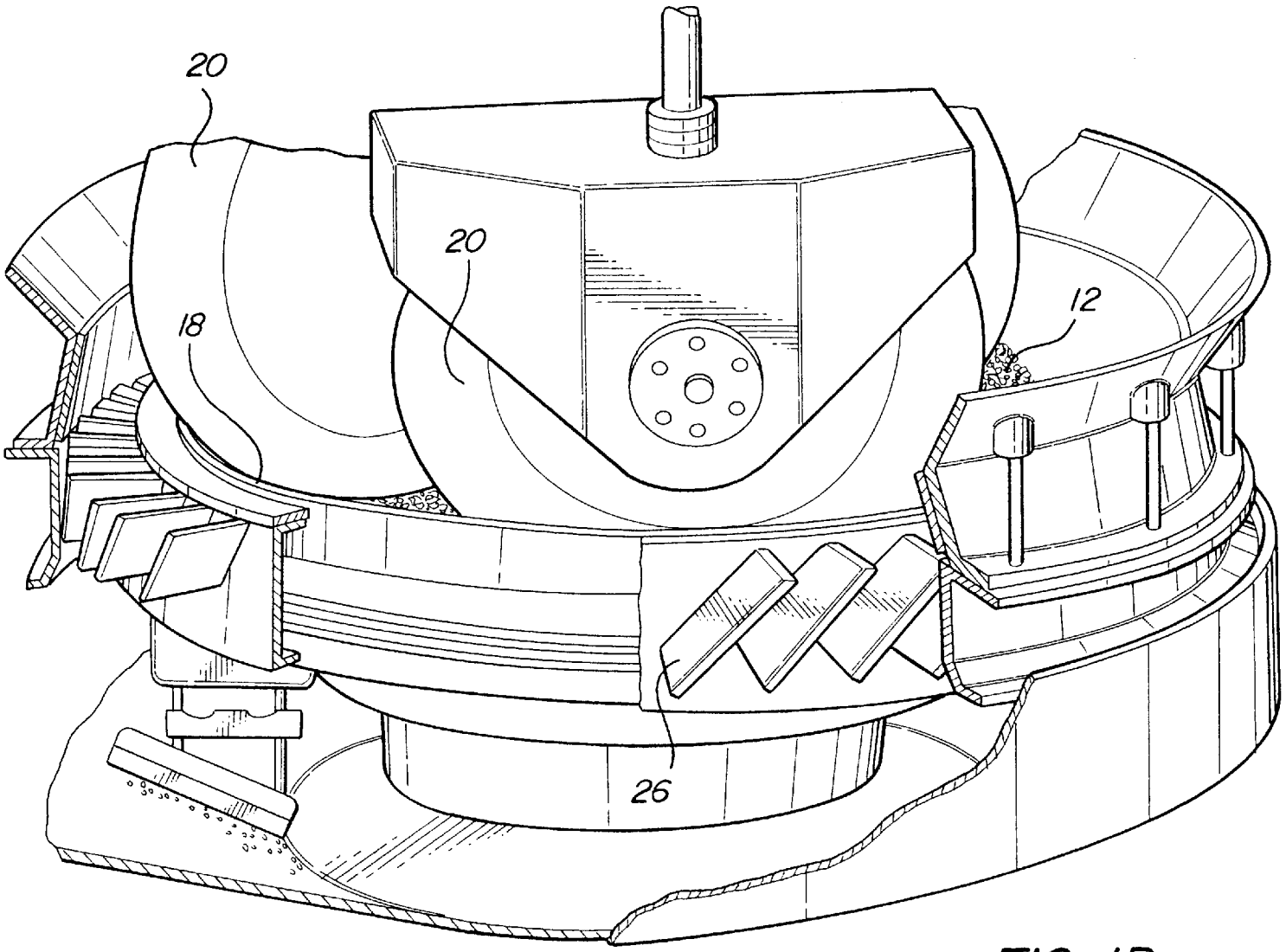
FIG. 1B is a detailed perspective view of the pulverizer throat vanes in FIG. 1A.

FIGS. 1A and 1B are perspective views of pulverizer and classifier structure similar to that shown in FIG. 1. FIG. 1A shows the relative angular orientation of throat vanes 26 in a rotating throat and the classifier vanes 36 in the cage. FIG. 1B shows the orientation of throat vanes 26 in more detail. The angular orientation of throat vanes 26 creates a spiral flow of air up and around the pulverizer with a rotational direction determined by the angle of vanes 26.

Figure 2:
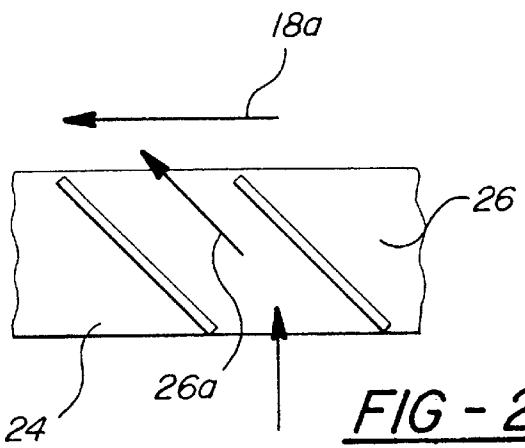
FIG. 2 is a schematic representation of a stationary pulverizer throat.

FIG. 2 is a schematic representation of a stationary pulverizer throat (viewed from outside the pulverizer) in which the grinding plate 18 rotates in a clockwise direction shown by arrow 18*a,* while throat 24 and vanes 26 remain stationary. The angular orientation of throat vanes 26 imparts a clockwise rotational flow direction to coal fines from the grinding ring, shown by arrow 26*a.*

Figure 3:
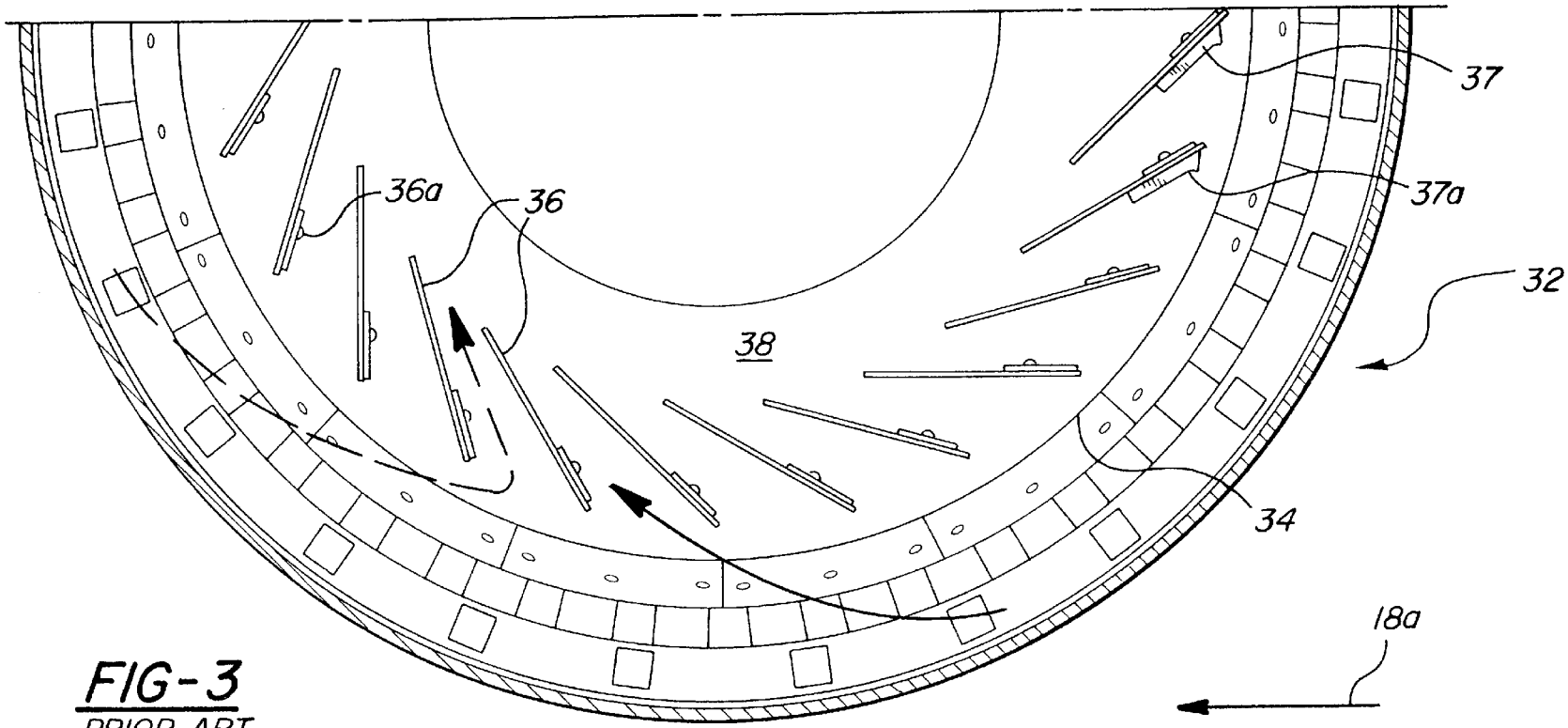
FIG-3 PRIOR ART
FIG. 3 is a plan view of a prior art classifier cage.

Referring now to FIG. 3, a prior art classifier cage 32 with classifier vanes 36 oriented for a stationary pulverizer throat is shown in plan view. Classifier cage 32 generally defines a circumferential inlet 34, with a plurality of classifier vanes 36 spaced circumferentially around the classifier cage in the inlet. Classifier vanes 36 are oriented in a direction originally set for the rotational flow (solid arrow) from a stationary pulverizer throat. Conversion to a rotating pulverizer throat (FIG. 4), however, results in a directional change for the air entering the inlet 34 of the classifier cage 32 (broken arrow). This reversal requires the coal/air flow to make a "U-turn" when it is guided by classifier vanes 36 into the classifier cone 38.

Two prior art attempts to improve control over the flow of coal/air entering the cone from the classifier cage 32 are illustrated in FIG. 3: classifier vanes 36 are of the slide-adjustable type described above, which can be lengthened or shortened with a known slide adjustment mechanism at 36*a*; and, curved classifier vane attachments 37 are shown on the inlet end of some of the vanes 36, with a curved leading edge 37*a* designed to smooth and improve the reversal of flow direction by the vanes. Despite these attempts, the prior art classifier cage inherently has two disadvantages. First, whatever type of vane is used, the coal fines entering classifier cone 38 from a rotating pulverizer throat lose a significant amount of velocity when they are directionally reversed by vanes 36, reducing the effectiveness of the classifier cone in separating heavier coal particles from lighter fines. Second, even with slide adjustments on classifier vanes 36, the vanes cannot adjust the tangential flow direction of the coal, regardless of its velocity, to optimize the centrifugal/spiral flow around the sides of the classifier on the way down. Pivot-adjustable vanes are also known, some with built-in curvature (FIG. 6). They have likewise been found insufficient to compensate for reversed flow from a rotating throat.

Figure 4:
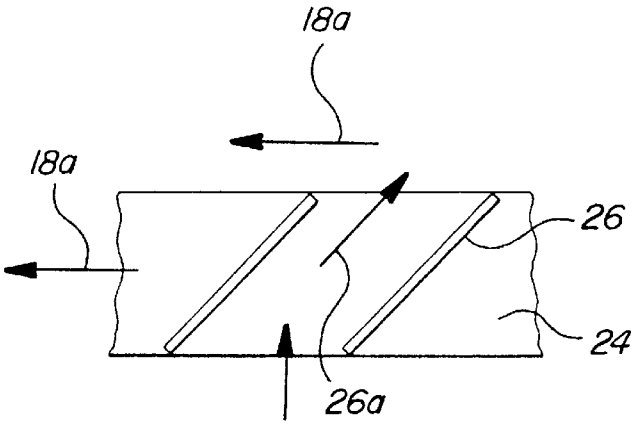
FIG. 4 is a schematic representation of a rotating pulverizer throat showing reversed air flow through the rotating vane.

FIG. 4 is a schematic representation of a rotating pulverizer throat (viewed from outside the pulverizer) in which the grinding plate 18, throat 24 and vanes 26 rotate together in a clockwise direction shown by arrows 18*a*. The direction of throat vanes 26 is reversed from the direction of the stationary throat vanes shown in FIG. 2 to take advantage of the rotation and increase the efficiency of air flow. This, however, reverses the rotational directional of the air flow 26*a* from the throat, and hence the rotational direction of the coal fines entering the classifier cage is counterclockwise.

Figure 5:
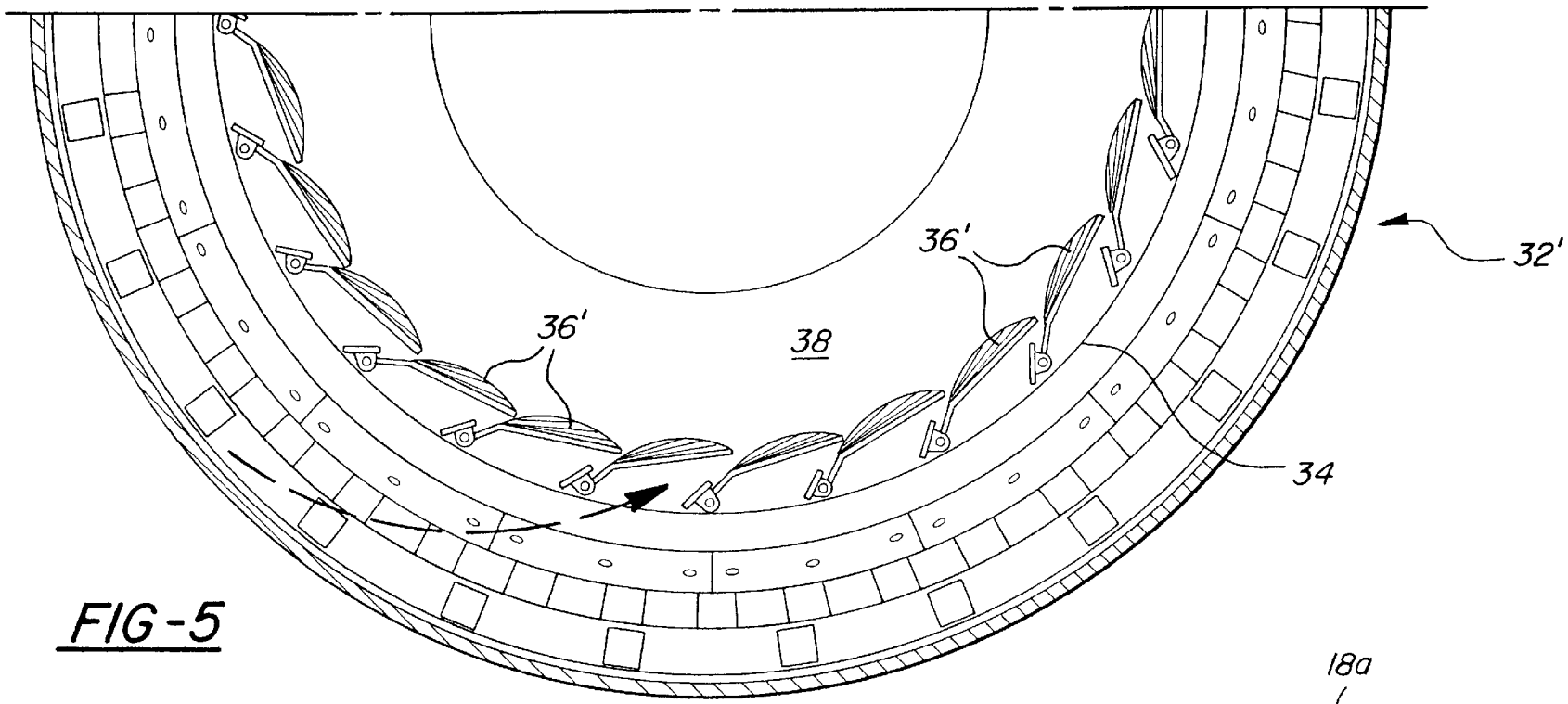
FIG. 5 is a plan view of a classifier cage provided with vanes according to a first embodiment of the invention.

Referring now to FIG. 5, a plan view of an improved classifier cage 32' equipped with improved vanes according to the present invention is shown with classifier vanes 36' whose direction has been reversed such that the rotational direction of the coal/air flow (counterclockwise broken arrow) from the rotating pulverizer throat through the classifier cage remains the same, with no reversal or "U-turn" as shown in FIG. 2. Accordingly, as the coal/air flow is directed down into classifier cone 38 by vanes 36', velocity remains higher for better centrifugal classifying action in the cone.

The improved vane geometry of the present invention will be best understood by first reviewing the geometry of a typical prior art attempt at controlling flow with a shaped vane. One type of prior art classifier vane is shown at 70 in FIG. 6, curved to better control and direct the coal/air flow entering the classifier cage. The prior art curved vane 70 has a tighter radius of curvature or "cup" at the upper end 71, the radius gradually increasing toward the bottom end 72 for a slight flare. The top edge is slightly longer than the bottom edge, such that when flat the vane is general rectangular and slightly wider at the upper end 71. Besides being oriented in a direction which requires a U-turn for reversed flow from rotating pulverizer throats, the prior art curved vanes as shown in FIG. 6 do not adequately direct the coal/air flow in the desired downward and tangential manner.

Referring now to FIGS. 7 and 7A, a first embodiment of an improved classifier vane according to the present invention is illustrated in use with the improved classifier vane orientation described above. When flat, the improved classifier vane 36' is generally trapezoidal with a wider lower end designed to extend down into the classifier cone below inlet 34*a*. Illustrative vane 36' has a vertical inlet edge 50 (later attached to pivot bushing 50*a*), a top edge 51 essentially perpendicular to inlet edge 50, a short bottom edge 52 essentially parallel to top edge 51, an angled or curved contour edge 53 cut away to approximate the angle or curvature of the inside surface of the classifier cone, a bottom extension edge 54 essentially parallel to top edge 51, and a trapezoidal free edge 55 angled outwardly from top to bottom.

While vane 36' is illustrated with a pivot mounting, it will be apparent to those skilled in the art that it can also be employed on the classifier cage with known slide mountings as discussed in FIG. 3, or can even be fixed in place.

Improved classifier vane 36' has two primary bend lines 56, 57 defining two primary vane surfaces 59, 60 with complementary functions. In the illustrated embodiment bend lines 56, 57 represent angles of approximately 10°. These angles can be varied to accommodate different classifier operating parameters; however, in general, the angle or curvature of outer vane surface 60 relative to base portion 58 and the incoming coal/air flow will be greater than that of central vane surface 59. This is best shown in the plan views of FIGS. 5 and 7B.

For consistency, vane deflector surfaces for the different embodiments disclosed herein will generally be labeled "primary" and "secondary" according to the relative size of their surface areas, and "inner" and "outer" according to their position relative to the classifier cage inlet. The bend lines for the vane deflector surfaces will be labeled in similar fashion.

Figure 7B:
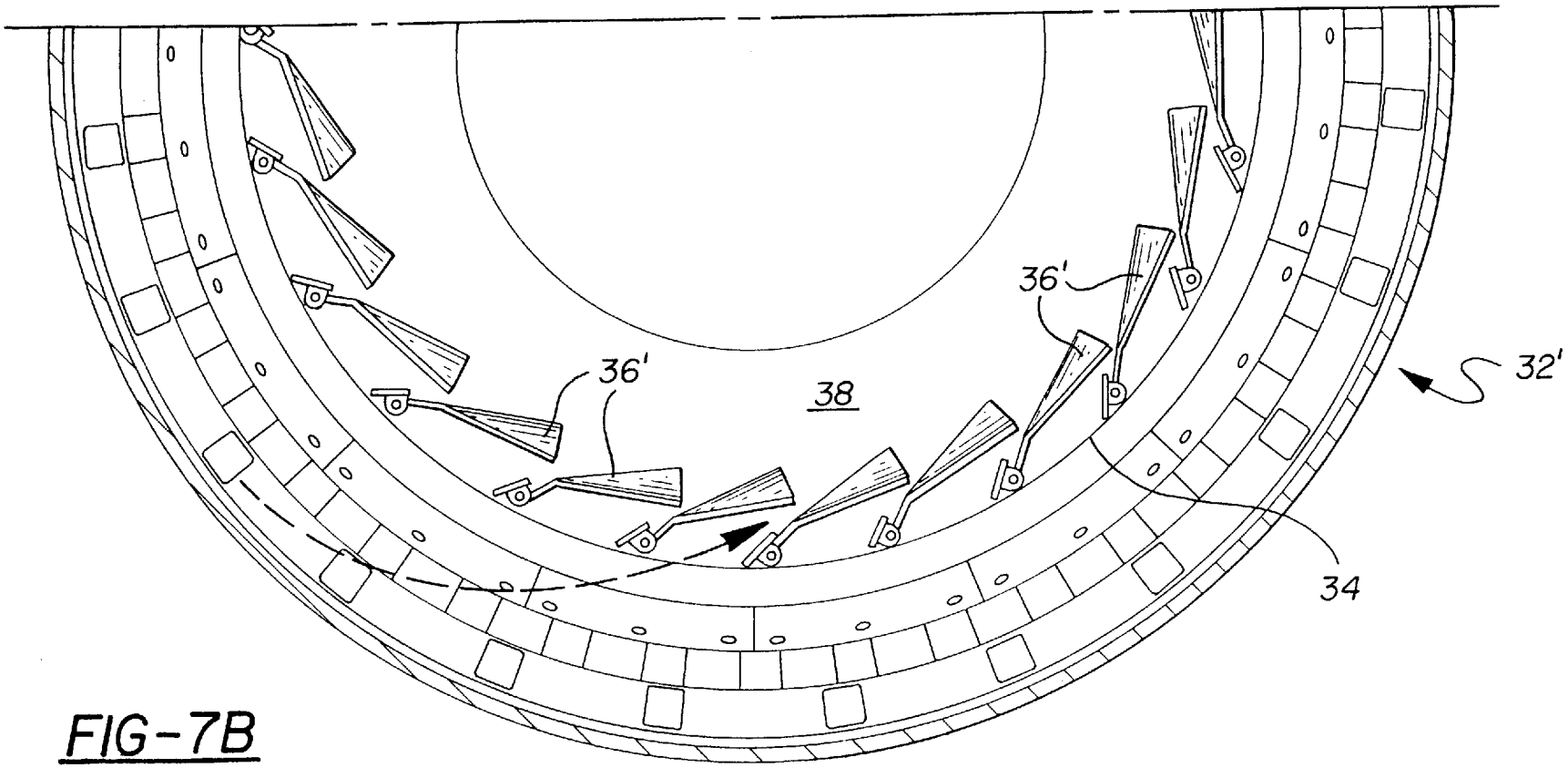
FIG. 7B is a plan view of a classifier cage with an alternate version of the improved vane of FIGS. 5 and 7.

Central vane surfaces 59 may be essentially flat (planar) or curved, depending on the vane material and the process used to bend it around line 56. The bend lines on surface 59 between 56 and 57 represent angle or curvature across surface 59. Outer vane surface 60 can likewise be planar or curved as desired. In the illustrated embodiment, vane surfaces 59, 60 are generally curved for a smooth, relatively constant transition across the vane as shown in FIG. 5. FIG. 7B is a plan view of an alternate (planar) embodiment.

It will be seen by comparison with the prior art curved vane of FIG. 6 that the region generally bounded by contour edge 53, bottom extension edge 54, and outer free edge 55 comprises a significant extension which projects both downwardly and inwardly into the classifier cone. This generally trapezoidal extension, along with the complementary angles of central and outer vane surfaces 59, 60, significantly increases directional control over the coal/air flow both downwardly into the classifier and tangentially relative to the classifier cone surface. In contrast to prior art vanes as shown in FIGS. 1*a*, 3 and 6, the extension projects below the lower edge 34*a* of circumferential inlet 34 of the classifier cage 32 to better move the coal/air flow downwardly into the classifier cone. The outwardly-angled free edge 55 helps create a "funnel" effect toward the lower end of vane 36'. The funnel-shaped central vane surface 59 widens toward the bottom of the vane to provide an increased ability to control the tangential directional component of flow. The outer vane surface 60 is eared over from the top at a greater angle to impart initial downward directional control to the flow, decreasing in width toward the bottom of vane 36' so as not to interfere with the tangential funneling action of surface 59 at the point of release.

Figure 8:
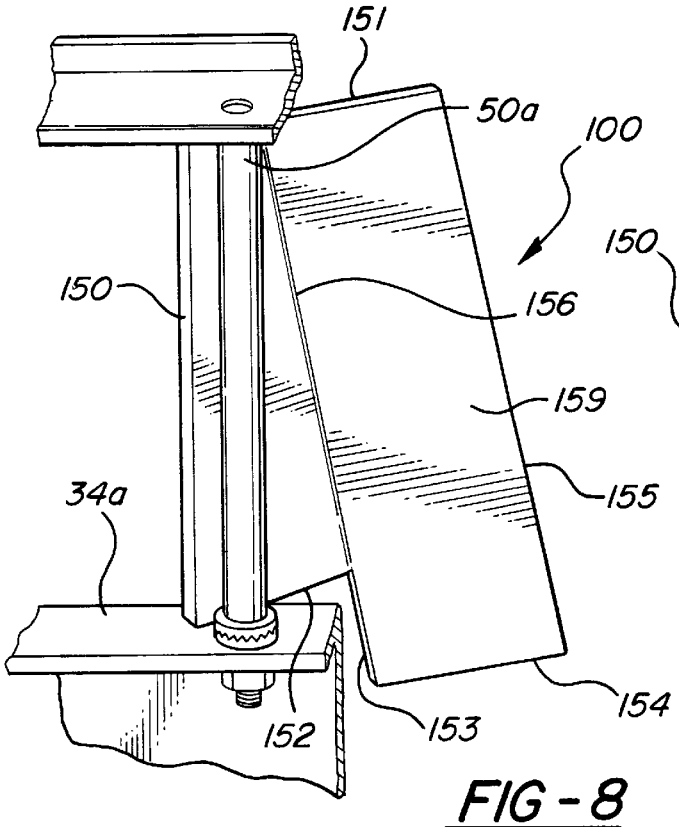
FIG. 8 is a perspective view of a second embodiment of an improved classifier vane according to the present invention, in use with a classifier cage.
Figure 8A:
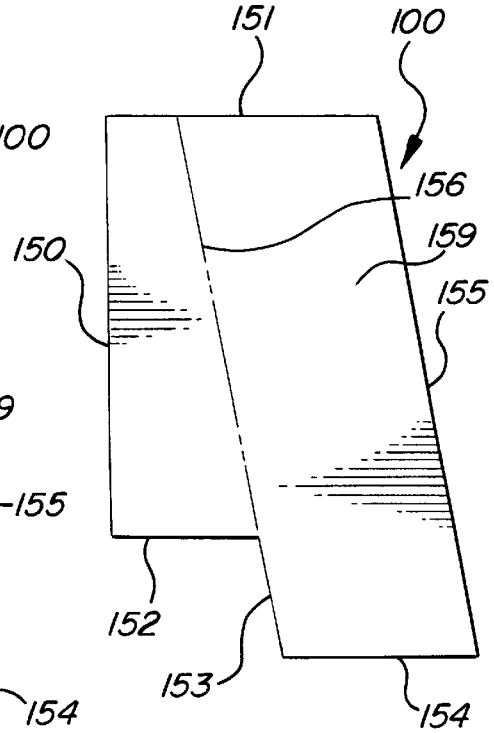
FIG. 8A is a front view of the vane of FIG. 8, laid flat.

Referring now to FIGS. 8 and 8A, a second embodiment of an improved trapezoidal-style vane according to the present invention is illustrated at 100, employing a different bend line configuration than that shown in FIGS. 7 and 7A. Vane 100 has the same generally trapezoidal shape as vane 36' in FIG. 7; i.e., illustrated vane 100 has a vertical inlet edge 150 mounted in the classifier cage inlet and/or attached to a pivot or slide adjustment mechanism; a top edge 151 essentially perpendicular to inlet edge 150; a short bottom edge 152 essentially parallel to top edge 151; an angled or curved contour edge 153 cut away to approximate the angle or curvature of the inside surface of the classifier cone; a bottom extension edge 154 essentially parallel to top edge 151; and a trapezoidal free edge 155 angled outwardly from top to bottom ("outwardly" with respect to the inlet edge of the vane).

Vane 100, however, is provided with a different bend angle configuration, having a single primary bend line 156 running downwardly and outwardly from a point at or near the upper inlet-side comer at the junction of edges 150 and 151 to the junction of edges 152 and 153. In a preferred form, bend line 156 is an extension of the cone contour-following contour edge 153.

In a further preferred form, bend line 156 terminates at its upper end at the point at which vane 100 is attached to a pivot connection such as bushing 50*a*. In this mounting arrangement, vane 100 accordingly pivots about the vertical axis which intersects bend line 156 at the upper end of the vane.

Trapezoidal free edge 155 is illustrated in a preferred parallel relationship to bend line 156. It will be understood by those skilled in the art, however, that this relationship may vary depending on the dimensions of the classifier cone and other related factors.

The angle and location of bend line 156 may vary somewhat, depending on installation requirements. For example, while the single bend line 156 will always extend at an angle from the upper inlet-side edge or comer of the vane outwardly to a point at or beyond contour edge 153, it need not be co-linear with edge 153.

This single primary bend line 156 creates a single vane deflector surface 159 which, when bent around line 156, creates an angled deflector surface which throws the coal fines down and into the cone with a desirable tangential relationship to the classifier cone surface.

It is believed that the single-bend vane 100 is preferable to the vane in FIG. 7 for certain classifier applications, namely larger coal mills with larger classifier cones.

It should be noted that edge 152 of vane 100 in FIG. 8 is longer than edge 52 of vane 36' in FIG. 7. The length of this edge will depend upon the spacing of the vane's pivot/mounting point from the inside edge of inlet flange 34*a*, and/or upon the width of the flange.

Figure 10:
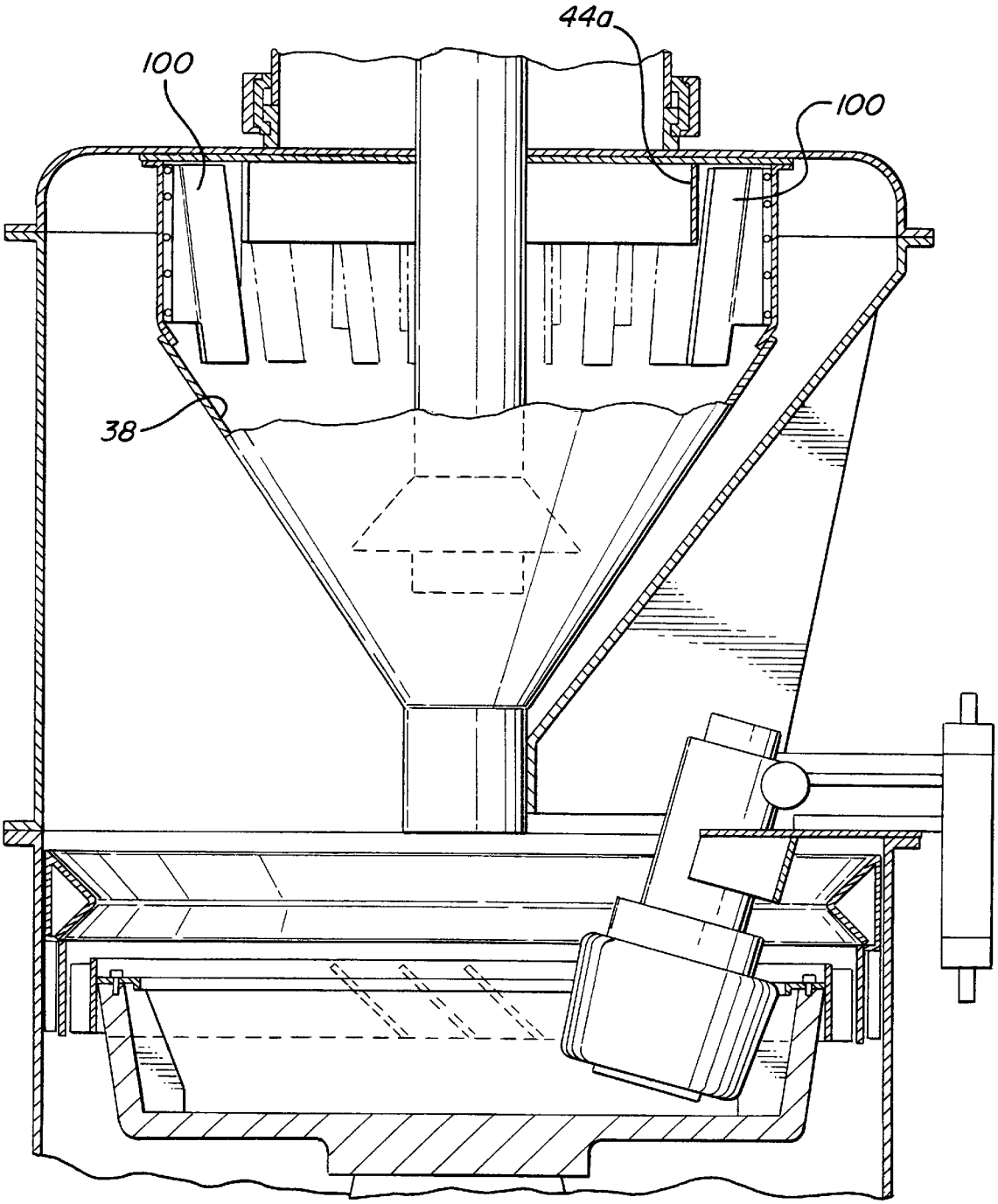
FIG. 10 is a side view, partially in section, of a classifier cone and cage using vanes according to FIG. 8.
Figure 11:
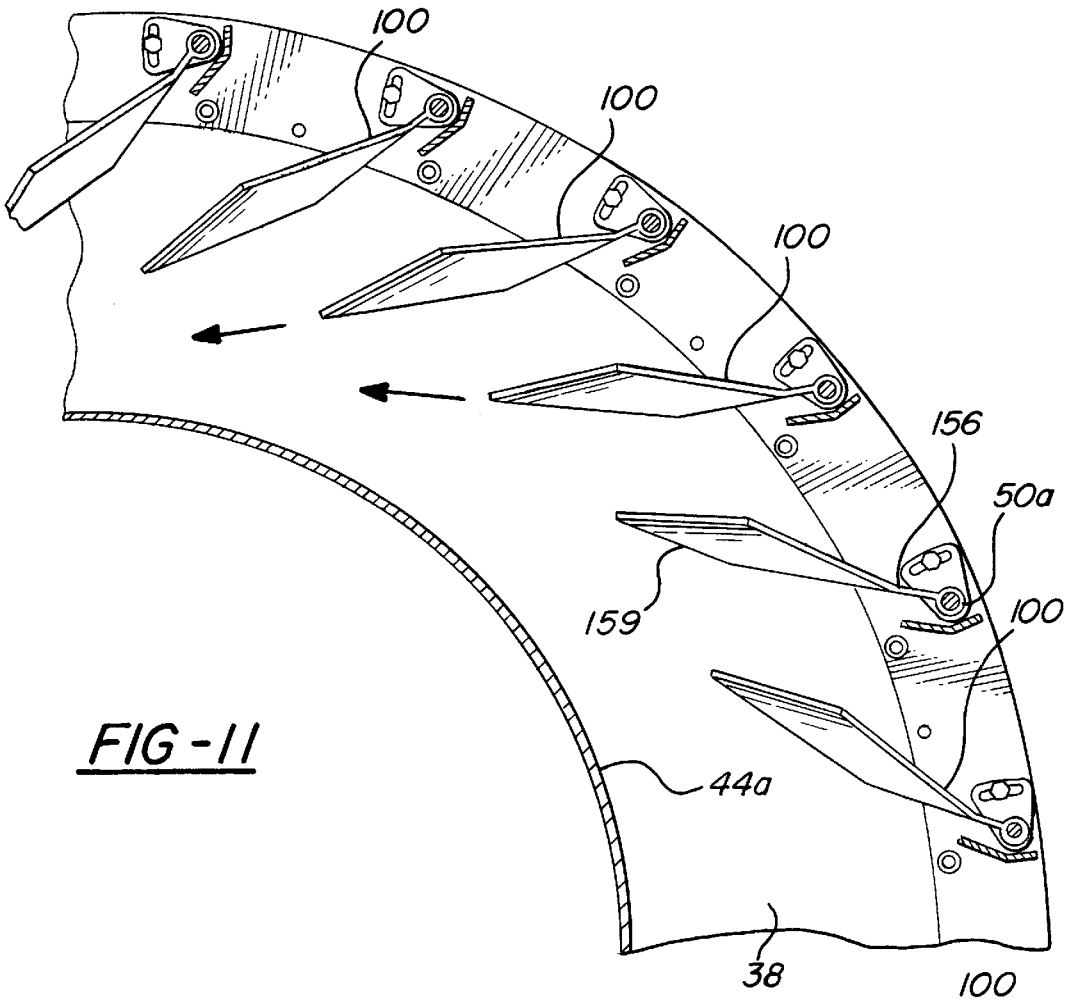
FIG. 11 is a plan view of a portion of the classifier cone and cage inlet of FIG. 10.

Referring to FIGS. 10 and 11, vanes 100 according to FIG. 8 are shown positioned in a classifier cage in a preferred arrangement. Factors to be considered in positioning vanes 100 include the need to avoid directing coal flow into the back of the next downstream vane and to angle the vanes properly to achieve a tangential flow of coal down and into the cone for the proper classifying swirl. Specifically, vanes 100 are angled in FIGS. 10 and 11 to maintain a tangential flow within the cylindrical volume between the classifier "skirt" 44*a* in the cone (See FIG. 1) and the classifier cone surface 38, thereby maximizing centrifugal flow velocity for proper classification. While the positioning of vanes 100 will vary depending on the dimensions of the particular cone, the angle shown in FIG. 11 is generally preferred, with vane deflector surface 159 of vanes 100 positioned to throw coal downward and tangentially relative to classifier skirt 44*a*, as shown by the arrows. This directional control ensures that the coal initially engages cone surface 38 traveling in a tangential direction at relatively undiminished velocity, thereby allowing the cone to impart an efficient swirling action for classification.

The single-bend vane 100 of FIG. 8 redirects coal flow differently than the vane 36' shown in FIGS. 7 and 7A. The result is a more immediately tangential, less downwardly-directed flow, although the angle of primary bend line 156 does generate a gradual downward deflection angle. The degree of bend around line 156 can be adjusted depending on the dimensions of the classifier cone.

It will generally be preferable to space vanes 100 farther apart around the periphery of the classifier ring than the vanes 36' in FIG. 7. This greater spacing is schematically illustrated in FIG. 11. The exact spacing is a quantity which will be determined by those skilled in the art to optimize coal flow for the dimensions of a particular classifier cone. However, in general, the vane should be spaced far enough so that coal being redirected by an upstream vane does not strike the back of the next vane downstream vane; the deflector surface 159 should be angled to throw coal tangentially in the cylindrical volume between the inner cylinder and cone surface. Additionally, the width of deflector surface 159 at its widest point should generally not be so long as to "cut into" the downstream cone surface, which would result in coal being directed back into the cone surface with a perpendicular direction component.

An additional advantage of the single-bend vane 100 of FIG. 8 is that the angled bend line 156 results in deflector surface 159 redirecting more of the coal flow nearer the classifier cage inlet toward the upper end of the vane, where such redirection is needed most. As illustrated best in FIGS. 8 and 11, bend line 156 (and correspondingly deflector surface 159) begin at or near the pivot point of the vane in the classifier inlet, near pivot bushing 50A.

Figure 9:
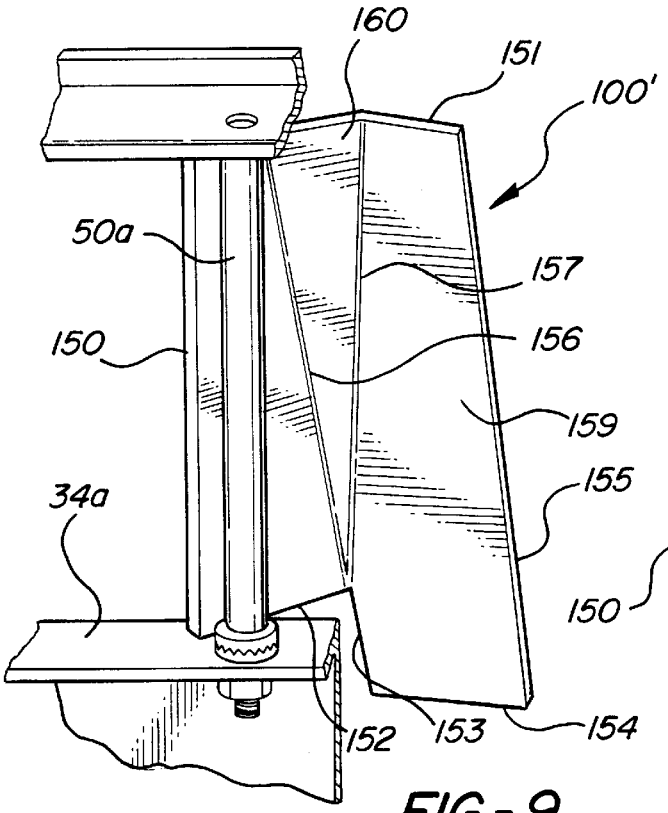
FIG. 9 is a perspective view of a modified version of the vane of FIG. 8, in use with a classifier cage.
Figure 9A:
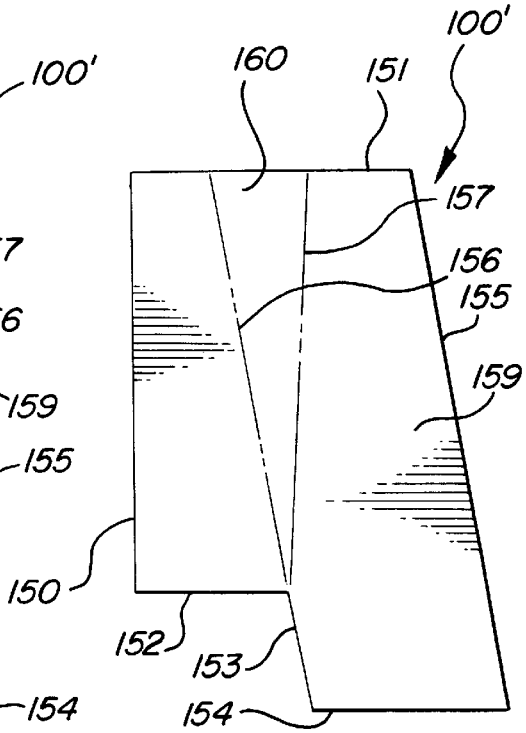
FIG. 9A is a front view of the vane of FIG. 9, laid flat.

Referring now to FIG. 9, a second variation of vane 100 is illustrated as vane 100', with an additional bend line 157 creating an intermediate deflector surface 160 upstream of main deflector surface 159. Intermediate deflector surface 160 is generally the opposite of the deflector region 159 shown in FIG. 7A; i.e., rather than a funnel-shape widening from top to bottom, it narrows from top to bottom. In the embodiment of FIG. 9, bend line 157 is the "primary" bend line, while bend line 156 is the "secondary" bend line.

The alternate dual-bend vane 100' of FIG. 9 provides a greater downward redirection component toward the outer, upper (edge 151) end of the vane which is nevertheless more gradual than that effected by vane 36' in FIG. 7. However, the intermediate funnel region 160 creates a smooth transition for coal redirection across the upper end of the vane, while narrowing to the junction of edges 152, 153, below which a transitional region is not needed since the remainder of the vane (edge 154) lies below the inlet level of the coal.

Figure 12:
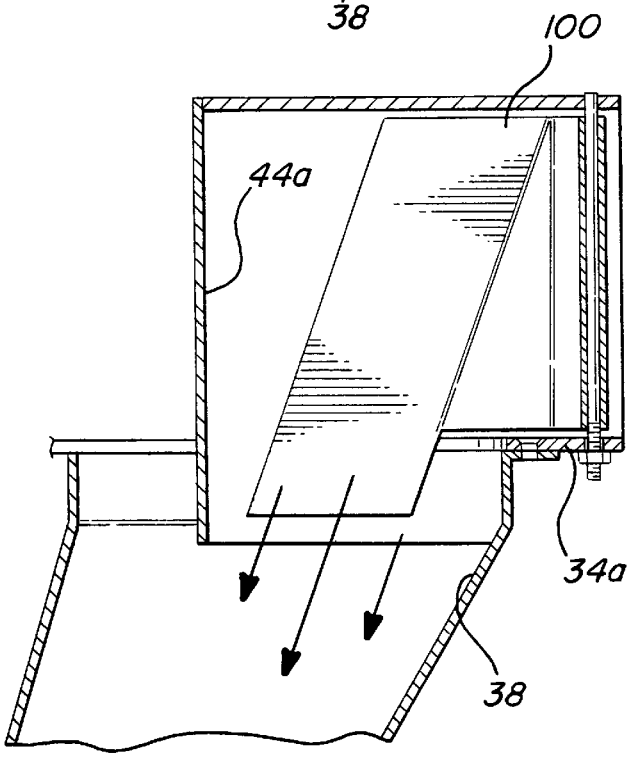
FIG. 12 is a detailed side view of one of the vanes of FIG. 10 and its position relative to the classifier cone and inlet; and, FIGS. 13 and 13A are another modified form of the vane of FIG. 8, shown from a perspective view and laid flat, respectively, with a second bend line near its inlet edge.

Referring to FIG. 12, vane 100 according to the present invention is illustrated in side view in a "full open" position relative to the cone, wherein the blade is oriented normal to the cone surface 38 and classifier skirt 44*a*. While vane 100 would generally not be used in this rotationally normal position, FIG. 12 illustrates the preferred angular shape of the main deflector surface 159 generally along a line aimed between the lowermost edge of skirt 44a and the adjacent surface 38 of the cone. Edges 155 and 153 need not exactly parallel the angle of cone surface 38, although as a general rule it is preferred that their angle be close to parallel to surface 38.

Figure 13:
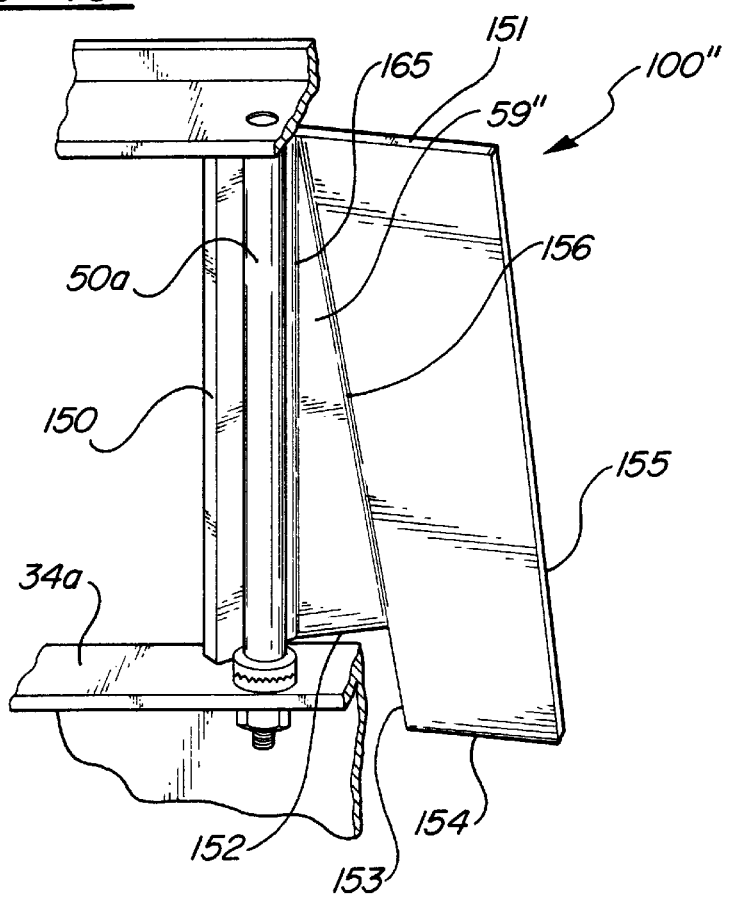

Lastly, referring to FIG. 13, yet a further alternate embodiment of vane 100, illustrated as vane 100", is illustrated with a vertical bend line 165 located adjacent inlet edge 150, preferably terminating at the uppermost point of primary bend line 156. Vertical bend line 165 has the effect of providing a funnel shaped intermediate deflector surface 59" radially outward toward the classifier inlet, and placing it at or in the inlet area depending on the width of the inlet. This application may be useful for small diameter classifier cones where it is desirable to more tightly wrap the deflector surface around its mounting point on the inlet toward the classifier cone surface.

It will be understood by those skilled in the art that the exact dimensions of the improved vanes according to the present invention can be varied to suit factors such as flow velocity, cone diameter, desired classifying results and related parameters to fine-tune the vanes for a particular application.

It will be apparent to those skilled in the art that the illustrated embodiments of the invention set forth above may be modified for different applications without departing from the scope of the claims.

Accordingly we claim:

1. For use in a classifier cage of the type used in bowl mill coal pulverizers to direct a flow of coal fines and air into a classifier cone, the classifier cage having a circumferential inlet for receiving a flow of coal fines from a pulverizer throat, an improved classifier vane comprising:

a classifier vane adapted to be mounted in the classifier cage inlet, the classifier vane having a mounting portion adapted to be mounted in the classifier cage inlet, and a deflector surface portion with a lower end designed to extend below the level of the classifier cage inlet to form a tangential coal-directing extension into the classifier cone when the vane is mounted in the classifier cage inlet.

2. The classifier vane of claim 1, wherein the classifier vane deflector surface portion has a trapezoidal outer edge widening toward the lower end of the vane.

3. The classifier vane as defined in claim 1, wherein the coal-directing extension includes a contour edge cut away to match the contour of an adjacent surface of the classifier cone.

4. The classifier vane as defined in claim 1, wherein the classifier vane deflector surface portion comprises a primary vane surface set at a first angle relative to the flow of coal fines past the vane.

5. The classifier vane as defined in claim 4, wherein the classifier vane deflector surface portion further comprises a secondary vane surface set at a second angle relative to the flow of coal fines past the vane.

6. The classifier vane as defined in claim 5, wherein the primary vane surface is upstream of the secondary vane surface relative to coal flow past the vane and widens in funnel fashion from top to bottom for tangential flow control, and the secondary vane surface is set at a second angle relative to the flow of coal fines past the vane which is greater than the first angle and narrows from top to bottom for downward flow control without interfering with the tangential flow control at the lower end of the vane.

7. The apparatus of claim 5, wherein the secondary vane surface is upstream of the primary vane surface relative to coal flow past the vane and narrows from top to bottom, and the primary vane surface widens from top to bottom.

8. The apparatus of claim 7, wherein the secondary vane surface is set at an angle about a secondary bend line beginning at an upper edge of the vane and angled outwardly as it extends downwardly along the vane surface, and the primary vane surface is set at an angle around a primary bend line beginning at an upper edge of the vane outwardly of the first bend line and angled inwardly as it extends downward across the vane surface.

9. Apparatus as defined in claim 4, wherein the primary vane surface is angled about a bend line beginning at an upper edge of the vane and extending at an angle outwardly toward the lower end of the vane.

10. The apparatus of claim 9, wherein the vane includes a bottom inlet edge overlying the inlet, and an angled contour edge extending downwardly and outwardly away from the inlet edge, the bend line terminating at the junction of the inlet and contour edges.

11. The classifier vane as defined in claim 1, wherein the deflector surface portion is angled inwardly and downwardly relative to the mounting portion to define a coal fine release point essentially tangential to an adjacent surface of the classifier cone when the mounting portion is mounted in the classifier cage inlet.

12. For use in a classifier cage of the type used in bowl mill pulverizers to direct a flow of coal fines and air into a classifier cone, the classifier cage having a circumferential inlet for receiving a flow of coal fines from a pulverizer throat, an improved classifier vane comprising:

a classifier vane adapted to be mounted in the classifier cage inlet, the classifier vane having a mounting portion adapted to be mounted in the classifier cage inlet, and a generally trapezoidal deflector surface portion extending radially into and downwardly in the classifier cone with a lower end extending below the classifier cage inlet to form a coal-directing extension when the vane is mounted in the classifier cage inlet, the deflector surface portion being angled inwardly relative to the classifier cone surface about a bend line dividing the mounting portion from the deflector surface portion, wherein the bend line is vertical.

13. For use in a classifier cage of the type used in bowl mill coal pulverizers to direct a flow of coal fines and air into a classifier cone, the classifier cage having a circumferential inlet for receiving a flow of coal fines from a pulverizer throat, an improved classifier vane comprising:

a classifier vane adapted to be mounted in the classifier cage inlet, the classifier vane having a mounting portion adapted to be mounted in the classifier cage inlet, and a generally trapezoidal deflector surface portion extending radially into and downwardly in the classifier cone with a lower end extended below the classifier cage inlet to form a tangential coal-directing extension when the vane is mounted in the classifier cage inlet, the trapezoidal deflector portion being angled inwardly relative to the classifier cone surface about a bend line dividing the mounting portion from the deflector portion.

14. The classifier vane of claim 13, wherein the bend line is angled to approximate the angle of the classifier cone surface.

15. The classifier vane of claim 13, wherein the bend line is vertical.

16. The classifier vane of claim 13, wherein the trapezoidal deflector portion comprises primary and secondary bend lines defining a primary vane surface and a secondary vane surface angled relative to the coal flow past the vane and relative to one another.

17. The classifier vane of claim 16, wherein the secondary vane surface is located downstream of the primary vane surface relative to the classifier cage inlet.

18. The classifier vane of claim 16, wherein the secondary vane surface is located upstream of the primary vane surface relative to the classifier cage inlet.

19. The classifier vane of claim 18, wherein the secondary bend line is vertical and the primary bend line is angled away from the mounting portion.

20. The classifier vane of claim 18, wherein the secondary bend line is angled away from the mounting portion.

21. For use in a classifier cage of the type used in bowl mill coal pulverizers to direct a flow of coal fines and air into a classifier cone, the classifier cage having a circumferential inlet for receiving a flow of coal fines from a pulverizer throat, an improved classifier vane comprising:

a classifier vane adapted to be mounted in the classifier cage inlet, the classifier vane having a lower end designed to extend below the level of the classifier cage inlet to form a coal-directing extension into the classifier cone when the vane is mounted in the classifier cage inlet, wherein the vane comprises an inner vane surface set at a first angle relative to the flow of coal fines past the vane, and further comprises an outer vane surface set at a second greater angle relative to the flow of coal fines past the vane.

22. A classifier vane as defined in claim 21, wherein the inner vane surface widens in funnel fashion from top to bottom for tangential flow control, and the outer vane surface narrows from top to bottom for downward flow control without inferring with the tangential flow control at the lower end of the vane.

23. The classifier vane of claim 21, wherein the inner vane surface narrows from top to bottom, and the outer vane surface widens from top to bottom.

24. The classifier vane of claim 23, wherein the inner vane surface is set at an angle about an inner bend line beginning at an upper edge of the vane and angled outwardly as it extends downwardly along the vane surface, and the outer vane surface is set at an angle around an outer bend line beginning at an upper edge of the vane outwardly of the first bend line and angled inwardly as it extends downward across the vane surface.

25. The classifier vane defined in claim 21, wherein the inner and outer vane surfaces comprise a deflector surface portion angled inwardly and downwardly relative to the classifier cage inlet to define a coal fine release point essentially tangential to an adjacent surface of the classifier cone.

26. For use in a classifier cage of the type used in bowl mill coal pulverizers to direct a flow of coal fines and air into a classifier cone, the classifier cage having a circumferential inlet for receiving a flow of coal fines from a pulverizer throat, an improved classifier vane comprising:

a classifier vane adapted to be mounted in the classifier cage inlet, the classifier vane having a lower end designed to extend below the level of the classifier cage inlet to form a coal-directing extension into the classifier cone when the vane is mounted in the classifier cage inlet, wherein the vane comprises an inner vane surface set at a first angle relative to the flow of coal fines past the vane, the inner vane surface being angled about a bend line beginning at an upper edge of the vane and extending at an angle outwardly toward the lower end of the vane.

27. The classifier vane of claim 26, wherein the vane includes a bottom inlet edge overlying the classifier cage inlet, and an angled contour edge extending downwardly and outwardly away from the inlet edge, the bend line terminating at the junction of the inlet and contour edges.

28. The classifier vane of claim 26, wherein the bend line is angled to approximate the angle of an adjacent classifier cone surface, such that the coal-directing extension defines a coal fine release point essentially tangential to the adjacent surface of the classifier cone.

29. For use in a classifier cage of the type used in bowl mill coal pulverizers to direct a flow of coal fines and air into a classifier cone, a classifier cage having a circumferential inlet for receiving a flow of coal fines from a pulverizer throat, an improved classifier vane comprising:

a classifier vane adapted to be mounted in the classifier cage inlet, the classifier vane having a mounting portion adapted to be mounted in the classifier cage inlet, and a generally trapezoidal deflector surface portion extending radially into and downwardly in the classifier cone with a lower end extended below the classifier cage inlet to form a coal-directing extension when the vane is mounted in the classifier cage inlet, the trapezoidal deflector portion being angled downwardly and inwardly relative to the classifier cone surface about a bend line dividing the mounting portion from the deflector surface portion, wherein the deflector surface portion further includes a secondary deflector surface formed by a secondary bend line in the deflector surface portion.

30. The classifier vane of claim 29, wherein the secondary vane surface is located upstream of the primary vane surface relative to the classifier cage inlet.

31. The classifier vane of claim 29, wherein the secondary vane surface is located downstream of the primary vane surface relative to the classifier cage inlet.

32. The classifier vane as defined in claim 29, wherein the trapezoidal deflector portion is angled downwardly and inwardly relative to an adjacent classifier cone surface so as to be essentially tangential to the adjacent surface of the classifier cone.

33. For use in a classifier cage of the type used in bowl mill coal pulverizers to direct a flow of coal fines and air into a classifier cone, the classifier cage having a circumferential inlet for receiving a flow of coal fines from a pulverizer throat, an improved classifier vane comprising:

a classifier vane having a mounting portion adapted to be mounted in the classifier cage inlet, and a deflector surface portion with a generally trapezoidal outer edge widening toward the lower end of the vane, the trapezoidal outer edge being extended below the level of the classifier cage inlet to form a tangential coal-directing extension designed to extend downwardly and inwardly into the classifier cone when the vane is mounted in the classifier cage inlet.

34. The classifier vane as defined in claim 33, wherein the deflector surface portion is angled inwardly and downwardly with respect to the mounting portion such that the trapezoidal outer edge defines a coal fine release point essentially tangential to an adjacent surface of the classifier cone when the mounting portion is mounted in the classifier cage inlet.

* * * * *

UNITED STATES PATENT AND TRADEMARK OFFICE
CERTIFICATE OF CORRECTION

PATENT NO : 5,957,300 
DATED : September 28, 1999
INVENTOR(S) : Nardi et al.

It is certified that error appears in the above-identified patent and that said Letters Patent is hereby corrected as shown below:

Column 5, line 51, delete "primary".

Column 5, lines 52, delete "two"; after "primary" insert --and secondary--; and after "vane" insert --deflector--.

Column 5, line 57, delete "outer" and insert --outermost, secondary--.

Column 5, line 59, delete "central" and insert --innermost, primary--.

Column 6, line 1, delete "Central" and insert --Primary-- and replace "surfaces" with --surface--.

Column 6, line 3, after "around" insert --primary bend-- and after "The" insert --interior--.

Column 6, line 5, replace "Outer" with --Secondary--.

Column 6, line 16, replace "central" with --primary-- and replace "outer" with --secondary--.

Column 6, line 25, replace "central" with --primary--.

Column 6, line 28, replace "outer" with --outermost, secondary--.

Column 6, line 32, before "surface" insert --primary vane--.

Column 7, line 7, after "single" insert --primary--.

Column 8, line 5, replace "50A" with --50a--.

UNITED STATES PATENT AND TRADEMARK OFFICE
CERTIFICATE OF CORRECTION

PATENT NO : 5,957,300
DATED : September 28, 1999
INVENTOR(S) : Nardi et al.

It is certified that error appears in the above-identified patent and that said Letters Patent is hereby corrected as shown below:

Column 8, line 8, replace "intermediate" with --inner, secondary--.

Column 8, line 9, replace "main" with --primary-- and replace "Intermediate" with --Secondary--.

Column 8, line 19, replace "intermediate funnel region" with --funnel-like, inner secondary vane surface--.

Column 8, line 23, after "inlet level" insert --34a-- and after "coal" insert --flow--.

Column 8, line 24, before "vane" insert --a-- and before "present invention" insert --Figure 8 embodiment of the--.

Column 8, line 26, replace "blade" with --deflector surface portion of the vane--.

Column 8, lines 28-29, after "rotationally normal position" insert --, and would not be flat as shown here for purposes of explanation--.

Column 8, line 30, after "generally" insert --angled--.

Column 8, line 31, replace "main" with --primary--.

Column 8, line 31, after "cone" insert --, as illustrated by the arrows--.

Figure 13A:
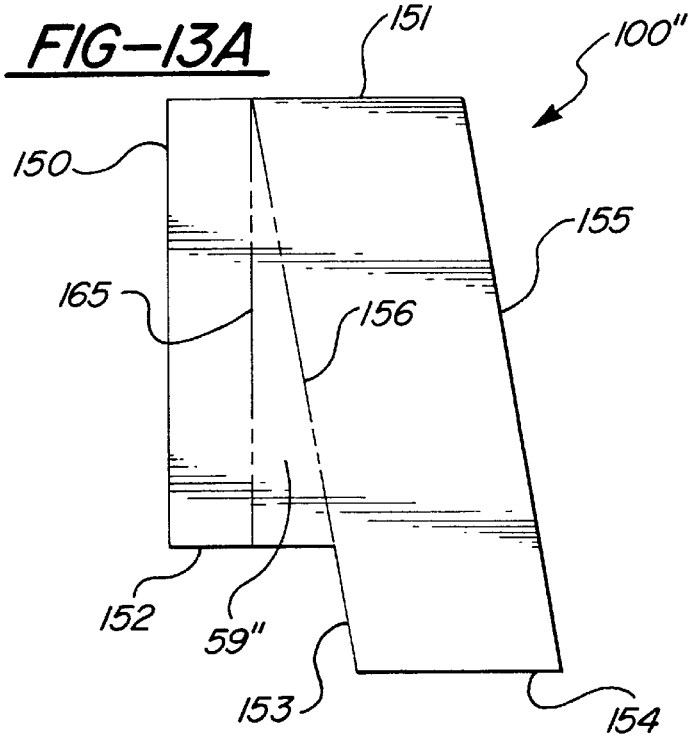

Column 8, line 36, change "Figure 13" to --Figures 13 and 13A--.

Column 8, line 39, after "vertical" insert --secondary--.

UNITED STATES PATENT AND TRADEMARK OFFICE

CERTIFICATE OF CORRECTION

PATENT NO : 5,957,300

DATED : September 28, 1999

INVENTOR(S) : Nardi et al.

It is certified that error appears in the above-identified patent and that said Letters Patent is hereby corrected as shown below:

Column 8, line 41, after "Vertical" insert --secondary--.

Column 8, line 42, delete "a" and insert --an inner-- and replace "intermediate" with --secondary--.

Column 8, line 43, delete "outward".

Signed and Sealed this

Thirtieth Day of May, 2000

*Attest:*

Q. TODD DICKINSON

*Attesting Officer*

*Director of Patents and Trademarks*